United States Patent [19]

Liao

[11] Patent Number: 5,004,637

[45] Date of Patent: Apr. 2, 1991

[54] SANITARY TEARING TOWEL

[76] Inventor: Chuen-Rong Liao, No. 10, Alley 3, Lane 127, Lei Chung St., Taichung City, Taiwan

[21] Appl. No.: 395,772

[22] Filed: Aug. 17, 1989

[51] Int. Cl.[5] ..... B32B 3/10

[52] U.S. Cl. ..... 428/43; 428/195

[58] Field of Search ..... 428/43, 195

[56] References Cited

U.S. PATENT DOCUMENTS 4,238,541 12/1980 Burton ..... 428/211

4,627,426 12/1986 Wegener et al. ..... 428/43

*Primary Examiner*—Alexander S. Thomas

*Attorney, Agent, or Firm*—Ladas & Parry

[57] ABSTRACT

The invention provides a kind of structural improvement of the towel. It is especially true for the towel with obvious predetermined tearing lines on its body. The user can distinguish the tearing lines are good or not to tell the towel has been used or not. The towel can not be recovered for reuse after it is torn off. It has "known before use", "use and disposal" features to guarantee clean and sanitary. It can be used to avoid the infection of infectious diseases to meet public health requirement.

2 Claims, 5 Drawing Sheets

SANITARY TEARING TOWEL

BACKGROUND OF THE INVENTION

The phrase "economy and sanitation" is the most useful advertising phrase in economic activities. It is especially true for restaurant sector. It is necessary to meet sanitary requirement under the condition of economic practical application. In addition to the prosperity of society, the advance of industry and the achievement of technology, the living standard of people has been greatly improved. It is shown on advertising media. There are various entertainments such as abroad sightseeing, domestic travelling, ex-ercise house, gymnasium aerobic dancing center, turkish bath, massage, video barbor shop etc. Besides, there are a lot of restaurants in every city. The "economy" is a major consideration factor and "sanitation" is also an important consideration factor for attending those activities. Even "sanitation" is considered much more important than "economy". That is although the price is not expensive, if the sanitation of service store is poor, the consumer will stay away. The requirement of "sanitation" is made necessary due to possible transmission of disease by carriers of germs, bacteria, or viruses. So there are many objects appeared such as disposable utensils, disposable chopsticks, paper cups, paper napkins, wet paper towels etc. These objects will increase the cost for the stores. But under the requirement of sanitation, mass production is used to reduce the unit cost, or part of cost is transferred to the customers. The purpose of this is to reduce the infection of caused by carriers of germs, bacteria, and viruses, such as B type liver infection. The concept of use and disposal is emphasized. So the objects will not be recovered by washing and disinfecting, because the bacteria will not be killed completely. It is easy to be infected by reuse. The concept of "use and disposal" is not only used by restaurants, but also used by the other business such as "one-time syringe head" and "ease-open can" etc. has the same goal.

For the above said "use and disposal" objects, a very important object is neglected, that is "towel". Towel is widely used and it can not be replaced by paper towel completely. The towel is used to contact body directly, so it is ease to be infected by carriers of germs, bacteria, and viruses. After the towel is recovered, it must be disinfected completely. As for current business, it is impossible to avoid the infection of various bacteria. If anything is neglected, the user will get disease. Especially some towels are packed, so people do not care much about disguised clean towel and they will get much more harm. The physicians often write articles on the press to give this kind of warning and suggestion. They hope the consumers do not use towel in public places to avoid getting disease. You had better carry your own towel when you go out, but this is very inconvenient.

The inventor of the invention studied the above said problem and considered current living environment, then he created sanitary tearing towel. The purpose is to avoid the infection of infectious towel and take economic consideration. Although the cost may be increased a little bit, the "towel" can be guaranteed to be used the first time to keep it clean and sanitary. And it can be distinguished as unused condition before use, so people can use it without any doubt.

The major purpose of the invention is to provide a kind of towel with predetermined tearing lines. The user can tear the towel through the tearing line to reach "use and disposal" purpose.

Another purpose of the invention is to set predetermined tearing lines on towel, so that the user can distinguish whether the tower has been used or not. So they will not reuse recovered towel because of negligence to reach "known before use" purpose.

SUMMARY OF THE INVENTION

The invention is associated with a kind of structural improvement of the towel. It means the towel can be torn in predetermined places. There are one or more predetermined lines which are set during the mass production of towel. The position of tearing lines are shown clearly. If you want use and dispose the towel, you can apply some force on the tower to tear it from the tearing line. The towel will be torn off and can not be recovered. At the public places, it can be used to avoid the infection of infectious diseases. If the towel is used as private towel, you don't have to tear off it to keep its original functions.

DESCRIPTION OF THE PREFERRED EMBODIMENT

Figure 1:
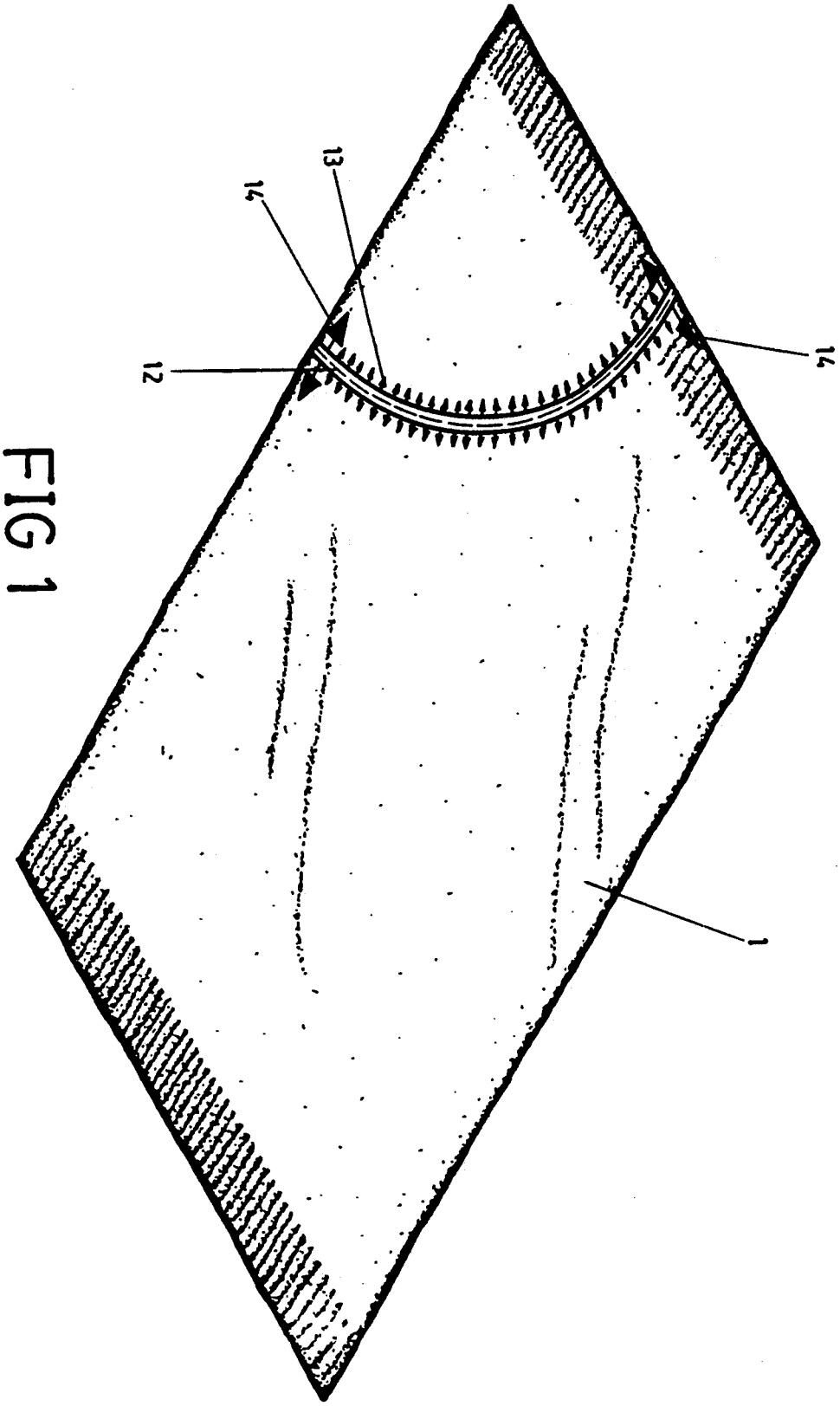
FIG. 1 shows the application of tearing towel for the invention.
Figure 2:
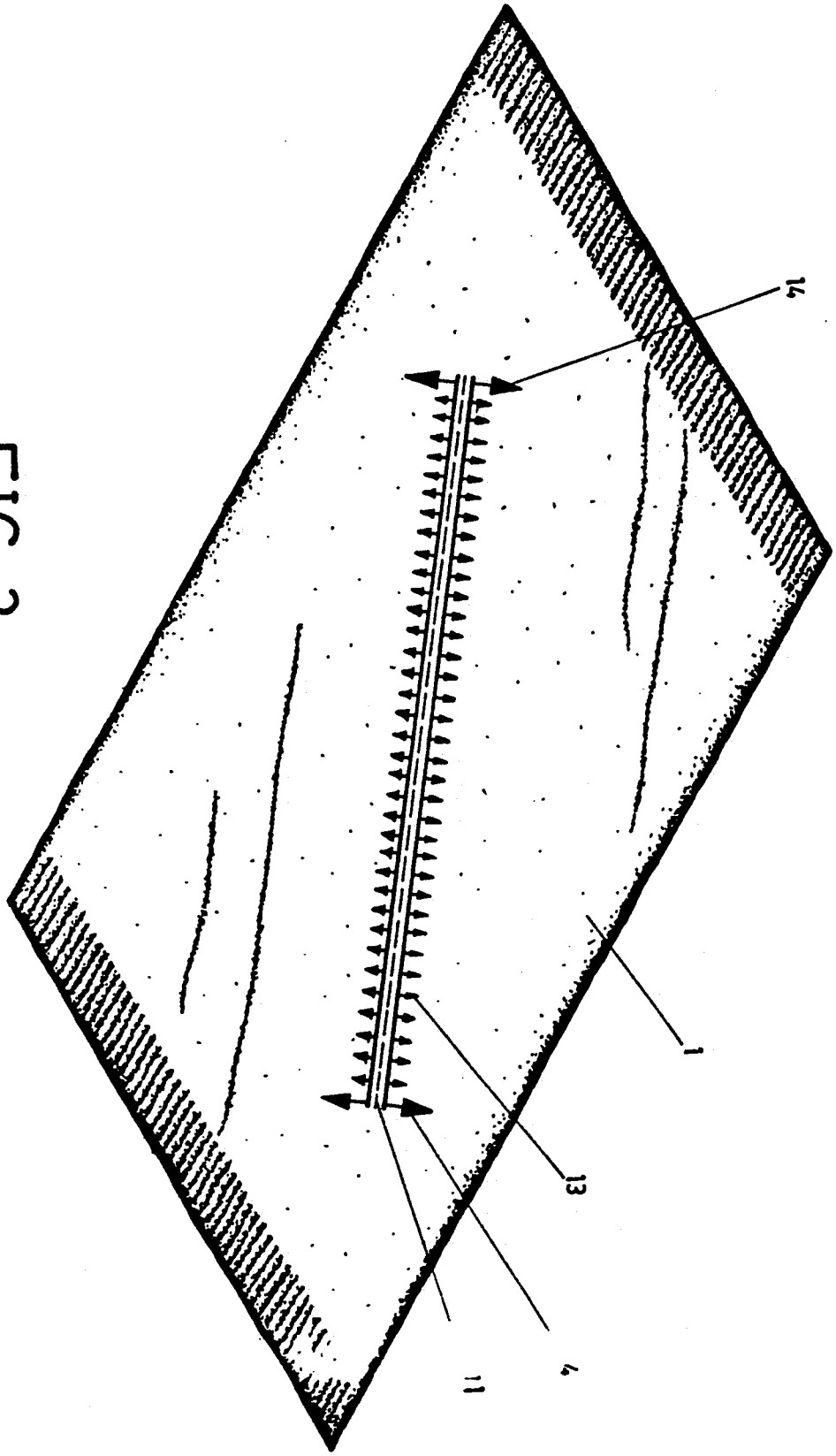
FIG. 2 shows another application of tearing towel for the invention.
Figure 3:
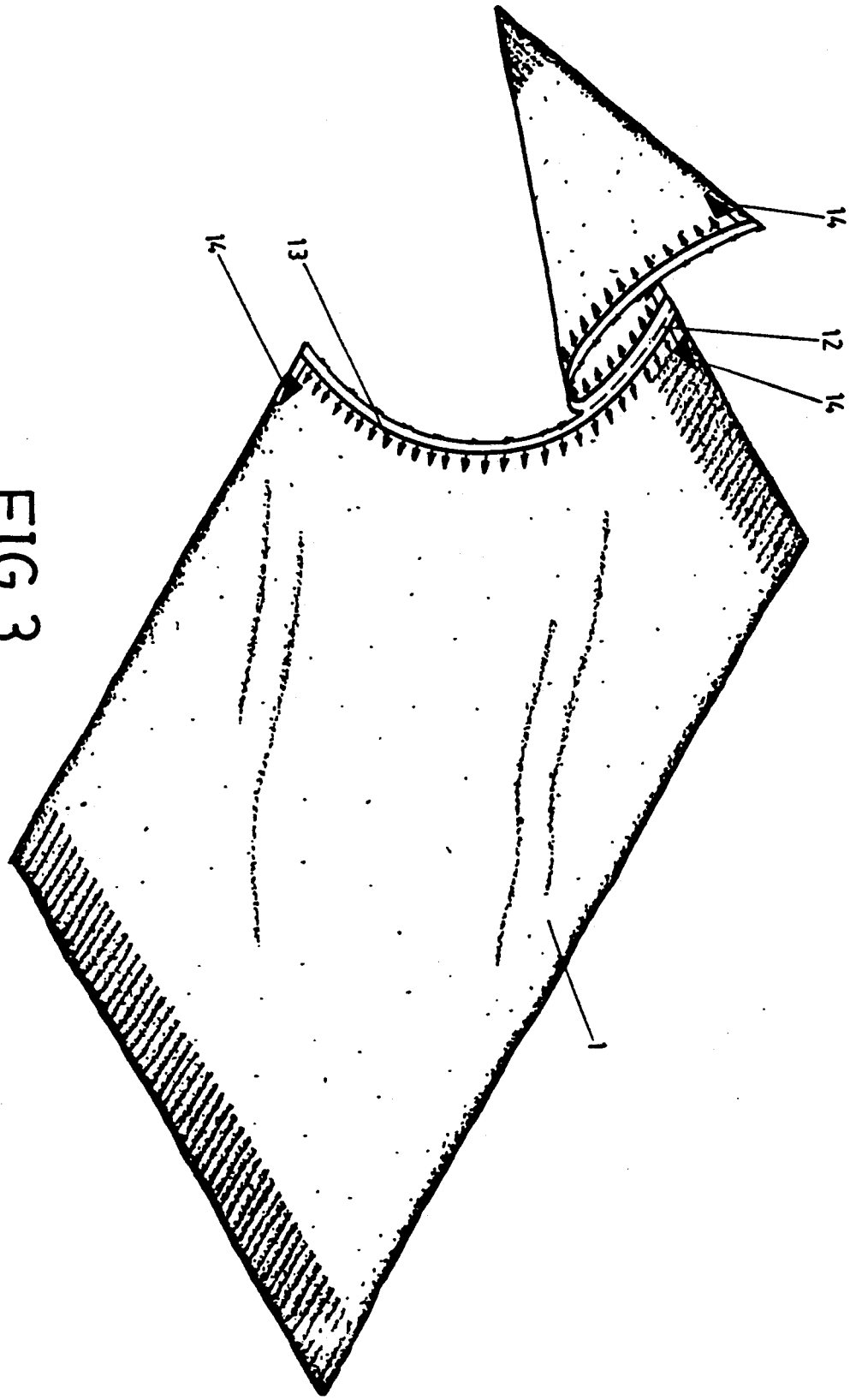
FIG. 3 shows the tearing process of the invention.
Figure 4:
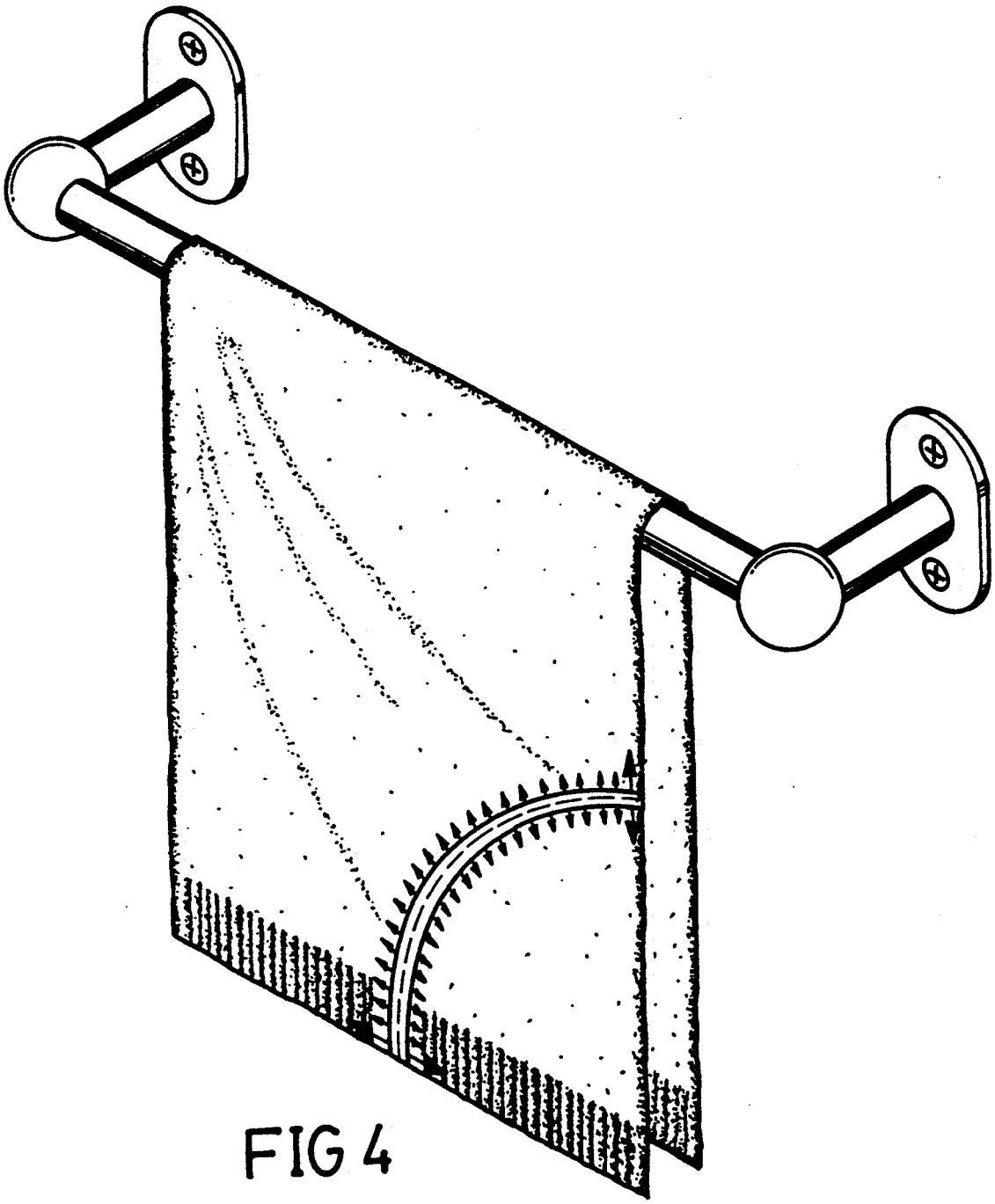
FIG. 4 shows the installation of tearing towel for the invention.
Figure 5:
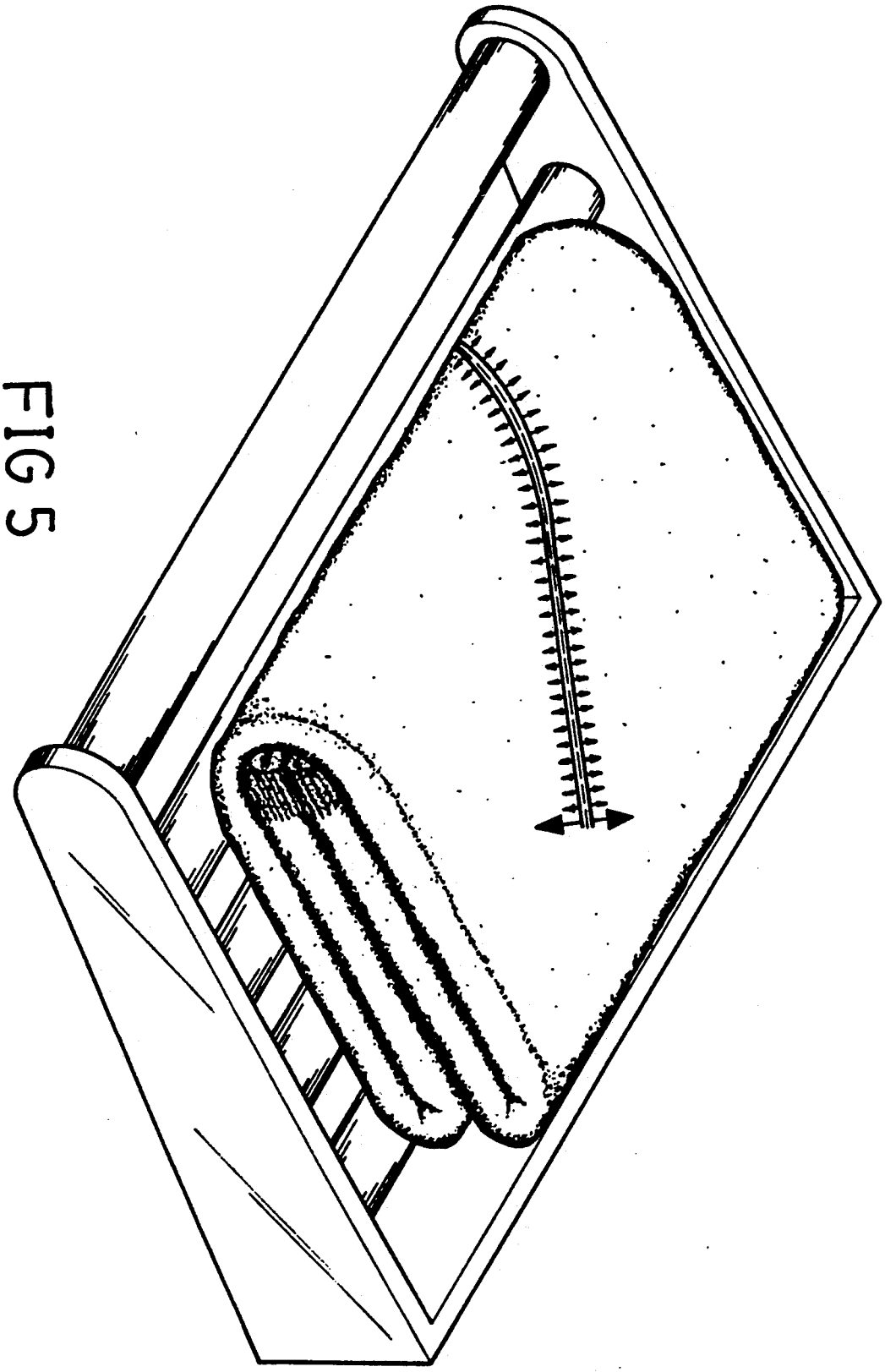
FIG. 5 shows the packing of the invention.

The invention is associated with the structure of sanitary tearing towel. Main body(1) is common towel body. It can be cut into various size as required. There are one or more straight tearing lines (11) which are prepared at the center of towel body by punching dotted holes, or arced tearing lines (12) can be formed at the corner of tower body (i). Obvious indication symbols (13) can be set near those tearing lines (11) or (12). It means the indication symbols (13) are set along those tearing lines (11) or (12). The arrows (14) are used to indicate the tearing side. When the towel is not tended to be reused, you can apply force against tearing lines (11) or (12) to tear it off. Or you can tear the tower (i) into several pieces at a time. The tower can not be recovered into original shape to get "use and disposal" purpose of the invention. The above said indication symbols (13) can be dyed during production to get obvious indication purpose without any problem. The tearing lines (11) and (12) indicated by these symbols are located at main positions of towel body. As shown in FIG. 4 and FIG. 5, the towel is installed on stack or piled on stack with indication symbols (13) can be seen clearly. The user can distinguish the tearing lines (11) or (12) are good or not to tell the towel has been used or not. So he can determine to use the towel or not. The stores can provide sanitary tearing towel with a little bit cost increase only to protect the health and safety of the customers.

I claim:

1. A sanitary tearing towel comprising at least one set of tearing lines defined by an area of weakness suitable for tearing, and tearing indication marks adjacent to said tearing lines indicating the position of said tearing lines, said tearing lines being provided to enable the severance of a portion of said towel to indicate previous use, wherein said tearing lines and tearing indication marks are located in an arc near a corner of said sanitary tearing towel.

2. A sanitary tearing towel comprising at least one set of tearing lines defined by an area of weakness suitable for tearing, and tearing indication marks adjacent to said tearing lines indicating the position of said tearing lines, said tearing lines being provided to enable the severance of a portion of said towel to indicate previous use, wherein said tearing lines and tearing indication marks are located in a line approximately diagonal to opposite corners of said sanitary tearing towel.

* * * * *